United States Patent [19]

Thorschmidt

[11] Patent Number: 4,540,390

[45] Date of Patent: Sep. 10, 1985

[54] METHOD AND APPARATUS FOR FORMING NOTCHES FOR GUSSETS FOR EXPANDABLE ENVELOPES

[75] Inventor: Donald Thorschmidt, Hicksville, N.Y.

[73] Assignee: Acebee Manufacturing Co., Clifton, N.J. ; a part interest

[21] Appl. No.: 517,010

[22] Filed: Jul. 25, 1983

[51] Int. Cl.[3] ..... B31B 31/02; B31B 31/26; B31B 1/28

[52] U.S. Cl. ..... 493/23; 493/252; 493/399; 493/918; 493/947

[58] Field of Search ..... 493/918, 940, 399, 23, 493/252, 947, 253, 251, 250, 463, 176, 175; 156/209, 207, 211, 217, 443, 474

[56] References Cited

U.S. PATENT DOCUMENTS

| | | | |
|---|---|---|---|
| 3,333,516 | 8/1967 | Waterworth et al. | 493/23 |
| 3,434,400 | 3/1969 | Hochfeld | 493/447 |
| 4,063,492 | 12/1977 | Lesek | 493/23 |
| 4,342,562 | 8/1982 | Froidh | 493/176 |

FOREIGN PATENT DOCUMENTS

| | | | |
|---|---|---|---|
| 561248 | 8/1958 | Canada | 493/463 |

*Primary Examiner*—Francis S. Husar
*Assistant Examiner*—William E. Terrell
*Attorney, Agent, or Firm*—Kenyon & Kenyon

[57] ABSTRACT

An improved method and apparatus for forming notches at a fold for the corner portion of an expandable gusset envelope, such as a file pocket. A pleated gusset member is placed on a ridged upper surface of a table structure of the apparatus, thereby initiating operation of the apparatus. The bottom portion of the pleated gusset member is clamped against the top of the table. Pressing rolls bend the end portion of the clamped gusset member downwardly against a ridged side surface of the table. The pressing rolls then are rolled upwardly with respect to the pleats of the end portion and form notches adjacent the fold at the clamped bottom portion of the gusset member. A plurality of stacked and gusset members can be notched at one time.

19 Claims, 15 Drawing Figures

52
56
53
56b
59
55
54
61
60
65a
65
65d
21
21d
21c
22
21c
21b
73
72
71
74
78
75
42a
42
43
25d
30
45
46
45b
50
47
32
25
28
33
34
39
35
36
38
37
39a
37a
23
41
24

56
52
53
54
56c
56b
59
55
72
73
71
78
30
45
45b
46
50
47
61
60
65a
65d
22
32
28
43
28
25d
28
34
39
35
37a
37
39a
41
42
38
23a
24

73
30
52
72
56
53
74
71
45b
46
54
56c
50
47
56b
55
78
75
59
32
61
28
25
34
60
39
65d
42
35
65a
39a
36
38
37a
37
23
41

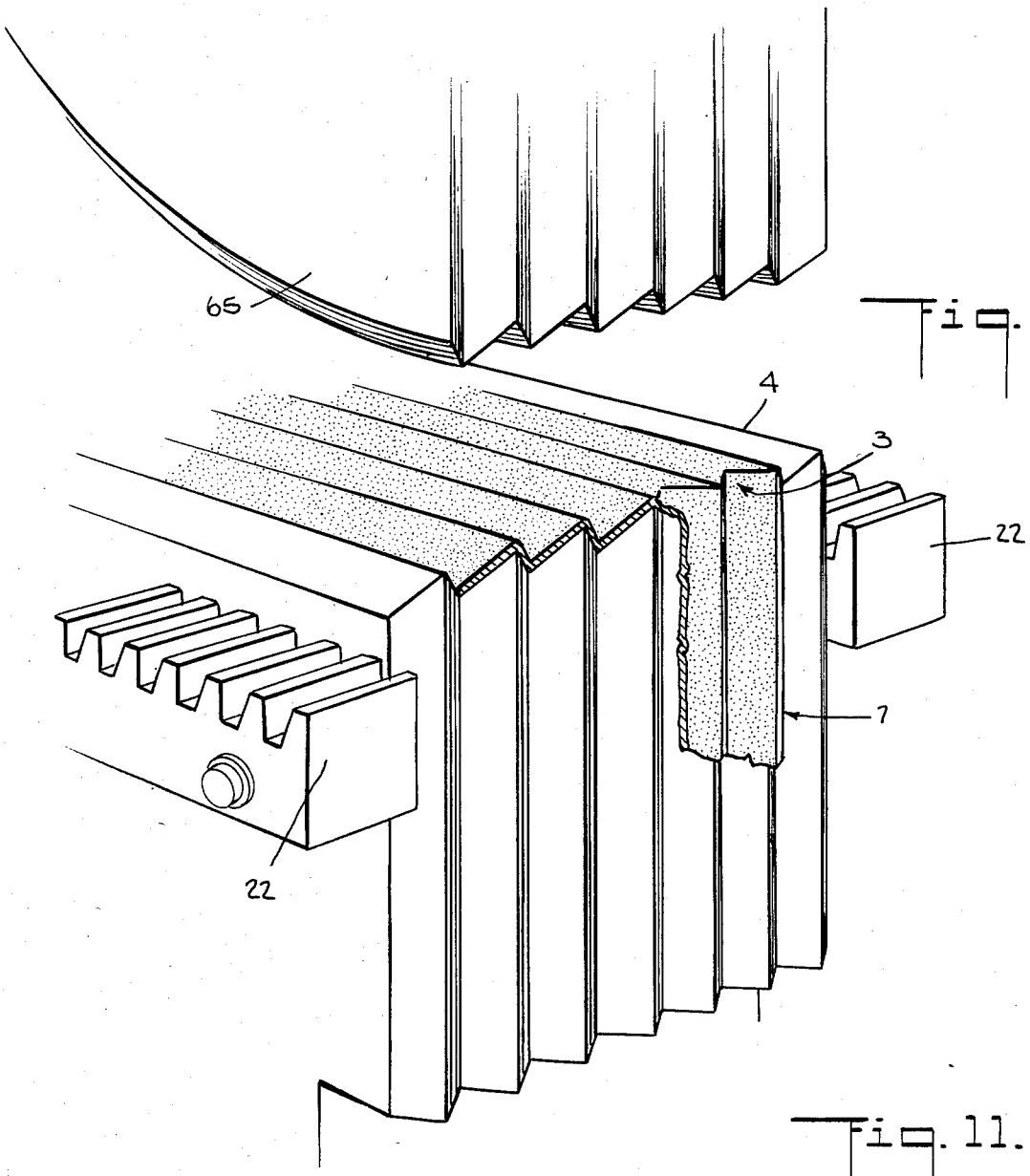
Fig. 10.
Fig. 11.
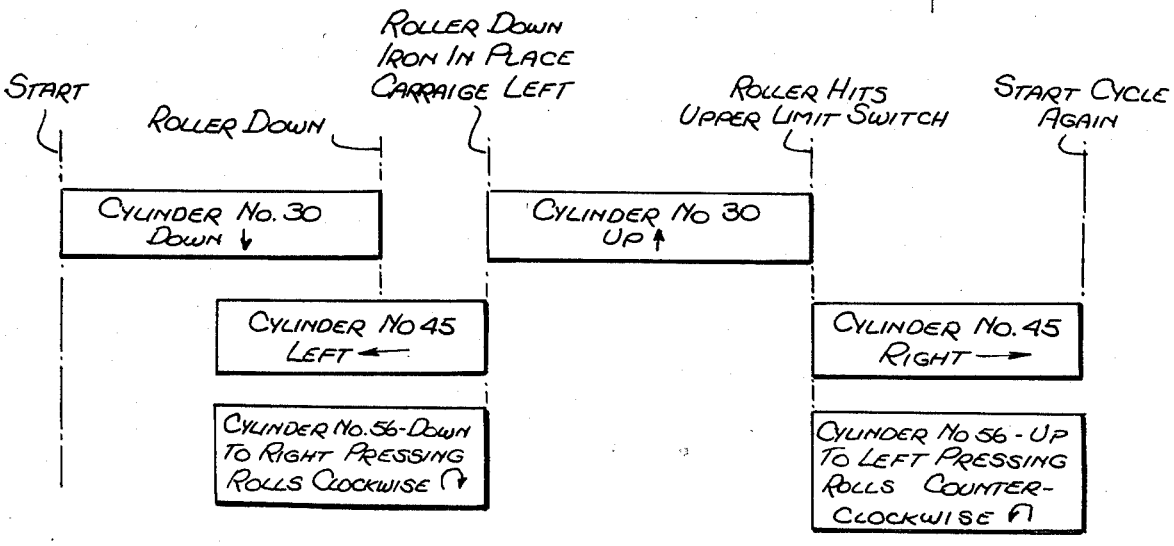

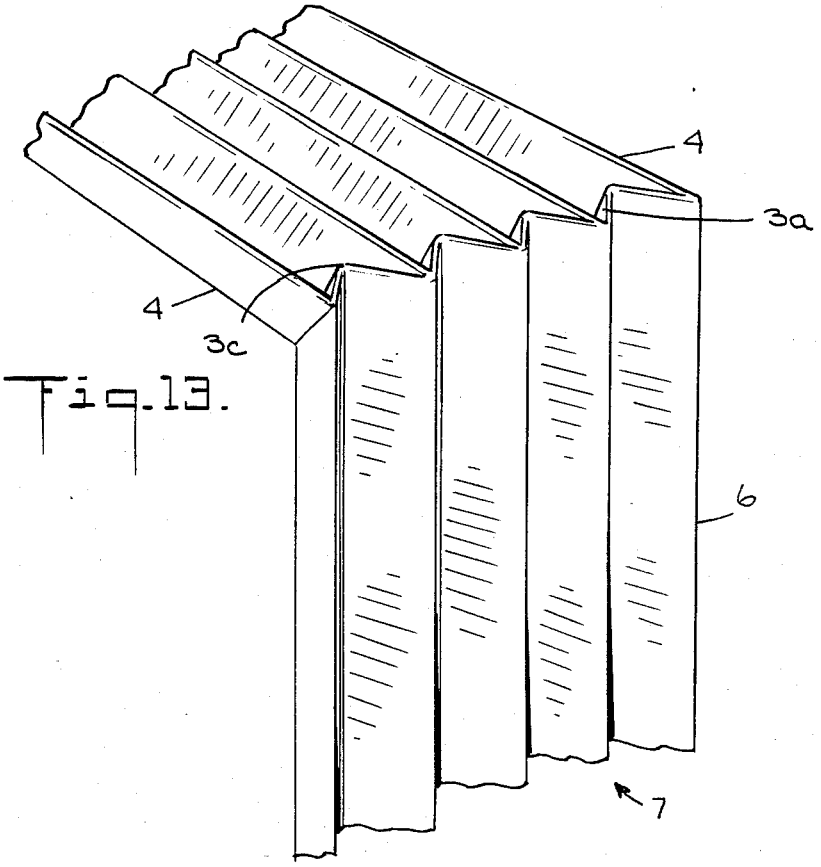
Fig.13.
Fig.14.
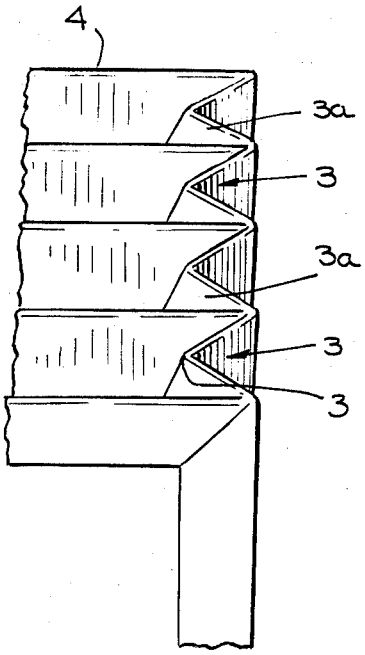
Fig.15.
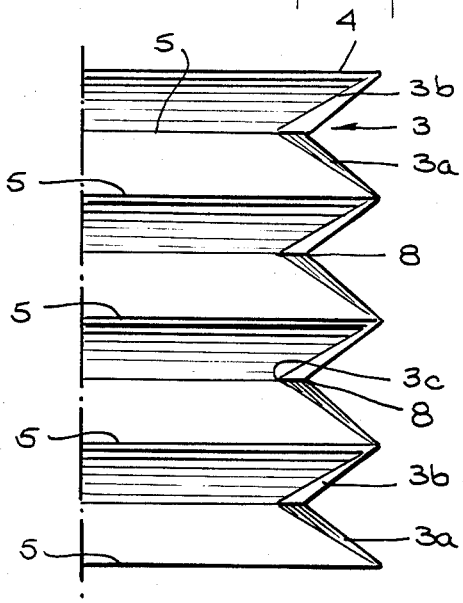

METHOD AND APPARATUS FOR FORMING NOTCHES FOR GUSSETS FOR EXPANDABLE ENVELOPES

BACKGROUND OF THE INVENTION

1. Field of the Invention

This invention relates to a new and improved method and apparatus for making an expandable gusset envelope, such as a file pocket. In particular, it relates to an improved method and apparatus for forming a folded corner portion in an accordion fluted or pleated gusset member for use in constructing such an envelope.

2. Description of the Prior Art

Expandable gusset envelopes and methods for fabricating such envelopes are well known. An example of an expandable gusset envelope is shown in U.S. Pat. No. 1,968,165 which issued on July 1, 1934. The expandable capability of such envelopes is derived from the accordion fluted or pleated structure which the gusset member possesses. Previous methods for fabricating such envelopes have the limitation that the fold of the corner portion must be made by hand, a method that is time consuming and wasteful of labor resources. In forming a corner portion by hand, the pleated or fluted gusset member is first provided with a score extending transversely to the length of the gusset member. A human operator then must form by hand V-shaped notches extending away from the score line adjacent the corner portion. Due to the fluted construction, a gusset member cannot be folded at a corner portion until the operator forms a notch between each flute adjacent the score line. The notches can be formed on either the side portion or the bottom portion of the gusset member, but preferably at the bottom portion. Not only is the manual forming of the notches at each of the two corner portions tedious and time consuming.

SUMMARY OF THE INVENTION

The invention comprises a novel apparatus and method for forming notches during the folding of the corner portion of a gusset member. The apparatus of the invention includes a table. The upper side and one vertical side of the table are ridged surfaces consisting of alternating crests and troughs forming "hills" and "valleys" of triangular cross-section. The ridged surfaces are in alignment with the result that a crest on the upper side of the table intersects a crest on the vertical side of the table. Above the table, an iron is rotatably mounted. The iron can rotate downwardly toward the top side of the table in order that its ridged bottom surface can nest against the ridged top of the table. The iron has a vertical face which is also ridged in order that the vertical face and the vertical side of the table can form a continuous ridged, vertical surface of alternating crests and troughs. A set of pressing rolls are mounted in a carriage supported on a frame which faces the ridged vertical side of the table. The rolls are positioned at a level above the top of the table when the machine is not operating.

In operation, typically three to six gusset members, which have been previously pleated as well as scored at the location of the corner portion, as shown in FIG. 3, is inserted into the apparatus of the invention so that it rests on the top side of the table. Insertion is made from the end of the top side of the table which is opposite to that which is ridged. Insertion continues until the first score on the gusset member is adjacent to the end of the top side of the table adjacent the vertical side thereof. When inserted, the end of the gusset member contacts an activation device mounted inside the apparatus which initiates the sequential operation of the apparatus. Rolls having a ridged surface adapted to mate with that of the vertical side of the table are then moved downwardly and toward the table. In doing this, the rolls bend the gusset member downwardly at the score and force the gusset member against the vertical ridged side of the table. The iron above the table is then rotated downwardly and toward the right as viewed in FIG. 7, thereby clamping the gusset member against the top side of the table. The rolls are then rolled upwardly along the surface of the gusset member which has its pleats nested with respect to the ridged vertical side of the table. As the ridged rolls move upwardly, the ridges forming the notches at the fold in the gusset member as the rolls pass the junction of the table and the iron. The iron and the rolls are then returned to their original positions. The folded and notched gusset member can then be removed from the table. Thereafter, the opposite end of the gusset member is inserted into the machine and the above cycle is repeated to form a second accordion fold with notches. Thereafter, the gusset member is ready to be combined with side walls in order to form an expandable envelope, as shown in FIG. 1.

A plurality of nested gusset members, the number being an inverse function of the thickness of the paper stock, can be folded and notched at one time by the apparatus of the invention.

It is thus an object of this invention to provide a method and apparatus for forming a pleated and folded gusset member for use in the fabrication of expandable envelopes.

BRIEF DESCRIPTION OF THE DRAWINGS

With the above and related objects in view, this invention comprises the details of construction and combination of parts as will be more fully understood from the following detailed description when read in conjunction with the accompanying drawings in which:

FIG. 10 is a fragmentary exploded perspective view showing a gusset member disposed on the ridged table and the iron disposed above the table;

FIG. 11 is a diagram showing the timing of the operation of the apparatus;

FIG. 13 and 14 are fragmentary perspective views of a gusset member having notches at a corner thereof; and FIG. 15 is a fragmentary plan view showing notches extending along the bottom panel of a gusset member.

DETAILED DESCRIPTION OF THE PREFERRED EMBODIMENT

Figure 1:
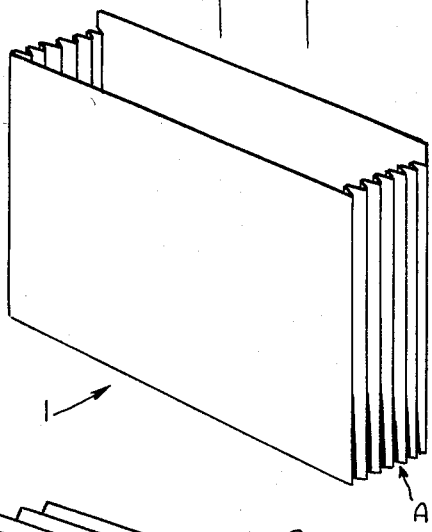
FIG. 1 is a perspective view of an expandable envelope.

Reference is made in greater detail to the drawings in which similar reference characters refer to similar parts.

Figure 2:
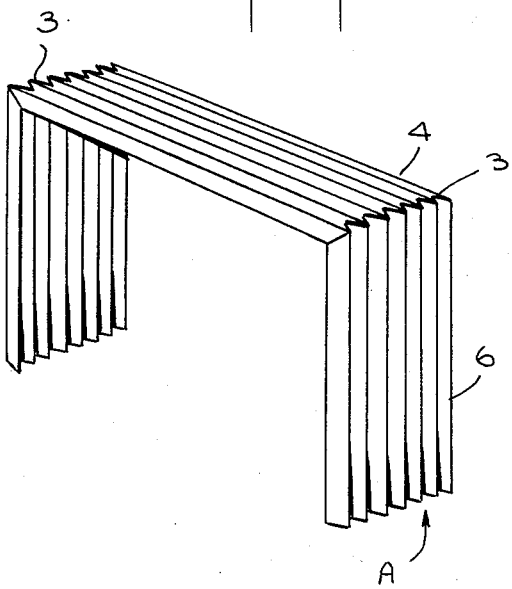
FIG. 2 is a fragmentary perspective view of a gusset member of an expandable envelope formed in accordance with the invention.
Figure 3:
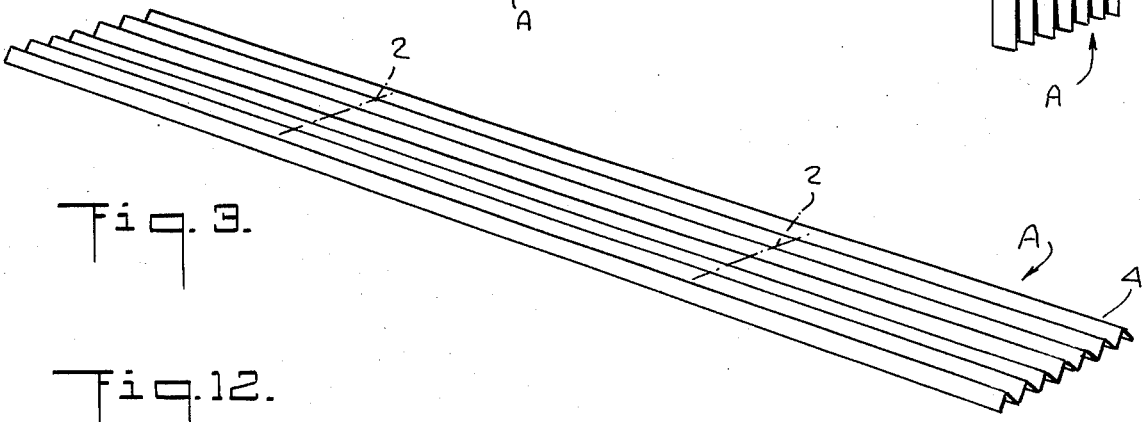
FIG. 3 is a fragmentary perspective view of a pleated and scored gusset member in an unfolded state.

FIG. 1 shows a pocket 1 having a pleated gusset member A of the type which is folded by the apparatus and method of the invention. Gusset member A as shown in FIG. 3 is provided with score lines 2 at the locations where a fold for a corner is to be made. FIG. 2 shows gusset member A after being folded and notched by the machine of the invention. The notches 3 are disposed between each of the crests 4 of the pleats of the gusset member and extend to the bottom 5 of each pleat. Each notch as shown in FIGS. 13, 14 and 15 have triangular sides 3*a* and 3*b*. The crests 6 of the side portion 7 of the gusset member (FIG. 13) intersect the crests 4 of the bottom portion while the grooves 8 of the side portion 7 intersect the apeces 3*c* of the notches in alignment with grooves 5 of the bottom portion.

Figure 4:
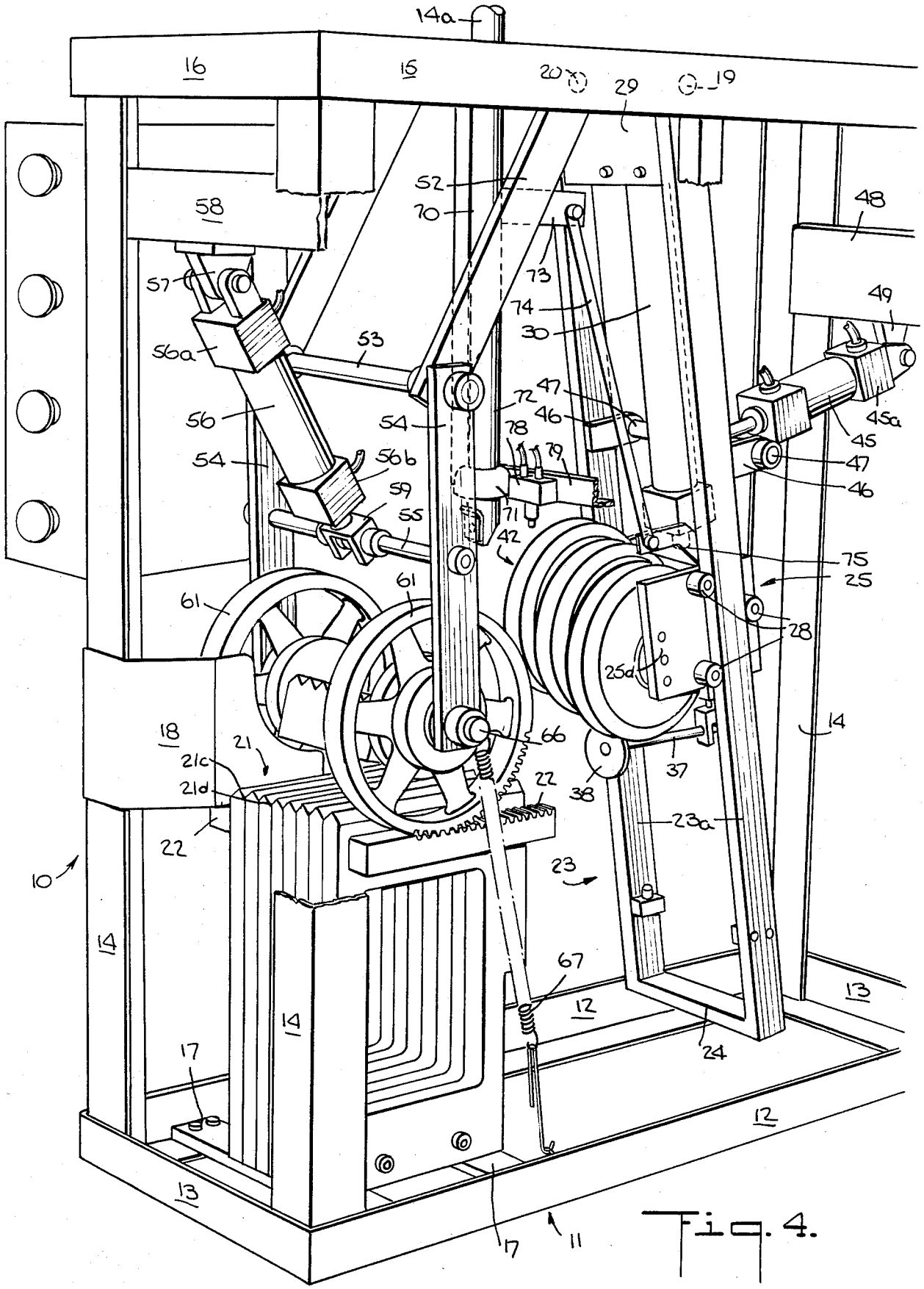
FIG. 4 is a fragmentary perspective view of the front portion of the apparatus of the invention.

A preferred embodiment of the gusset folding apparatus 10 is shown in FIG. 4. The main support frame 11 of the apparatus is formed by several elongated members, four forming the base, four forming the top portion and four serving as uprights. More particularly, the base comprises two elongated side members 12 and two short end members 13. Two flattened cross-pieces 17 are attached between the elongated side members 12 of the base. The top portion is constructed similarly from two elongated side members 15 and two short end members 16. The four uprights 14 are attached to the base members at their lower ends and to the top members at their upper ends. Guards 18 are attached to the uprights at one end of the frame 11 (only one bracket being shown). Attached between the two elongated side members 15 of the top portion are two cross-shafts 19 and 20. A fifth upright 14*a* is attached to the frame at approximately the midpoint of the rear elongated side of the machine.

Figure 6:
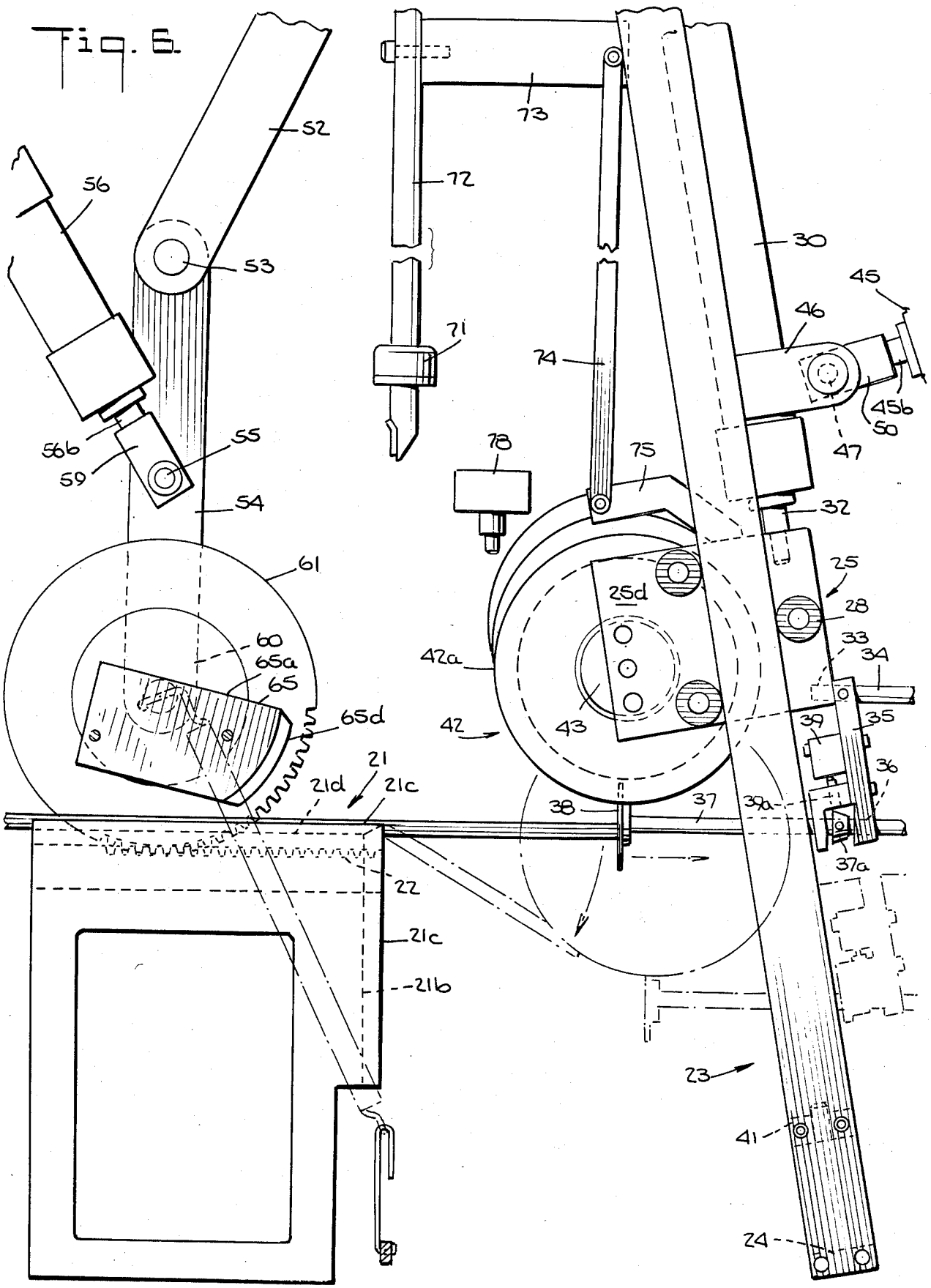
FIG. 6 is a fragmentary elevation view of the apparatus with the pressing roll assembly and carriage and the iron in their rest positions.
Figure 9:
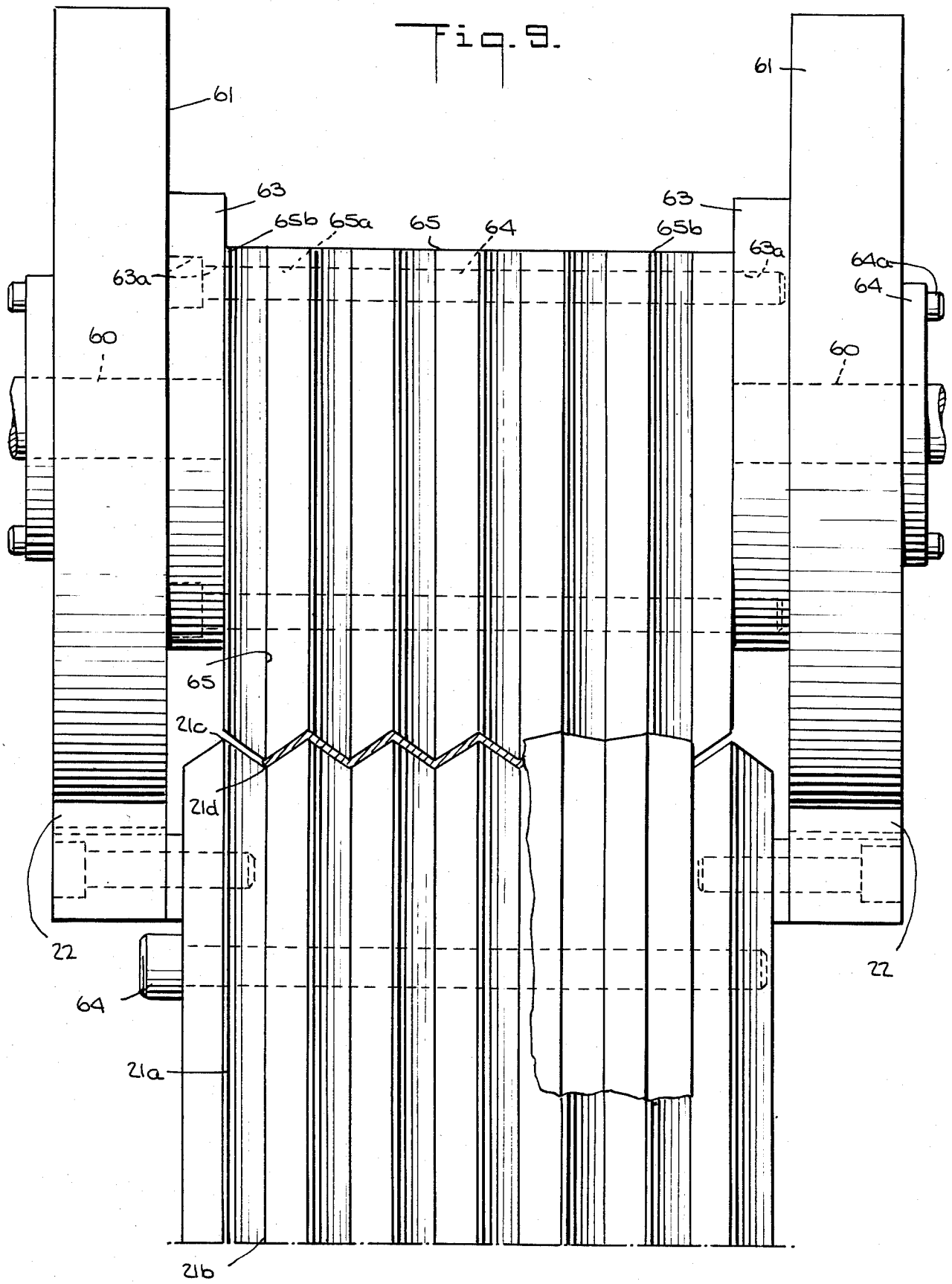
FIG. 9 is a fragmentary elevation view showing the table and iron with a gusset member clamped therebetween.

A table 21 is affixed to the cross-pieces 17 between the elongated sides 12 of the base so that the table's top is positioned between the guards 18 adjacent the racks and pinions which serve as guides. The vertical side of the table 21 is ridged with alternating crests 21*a* and troughs 21*b* of triangular cross-section (FIG. 6). The top of the table is similarly ridged with alternating crests 21*c* and grooves 21*d*. In addition, the crests of the top of the table and those on the side are in alignment, that is, a crest 21*c* on the top of the table intersects a crest 21*a* on the side of the table and a trough groove 21*d* intersects a groove 21*b* (FIG. 9). Gear racks 22 are attached to opposite sides of the table.

Suspended from the first cross-shaft 19 (FIG. 4) mounted in the top portion of the frame by side members 15 is a carriage support frame 23 made from two elongated side rails 23*a* and a short end member 24 mounted between the lower ends of the elongated side rails 12 (FIG. 4). The upper end of each side rail 23*a* has a circular bushing therein pivotally mounting the side rails 23*a* on the shaft 19.

Figure 5:
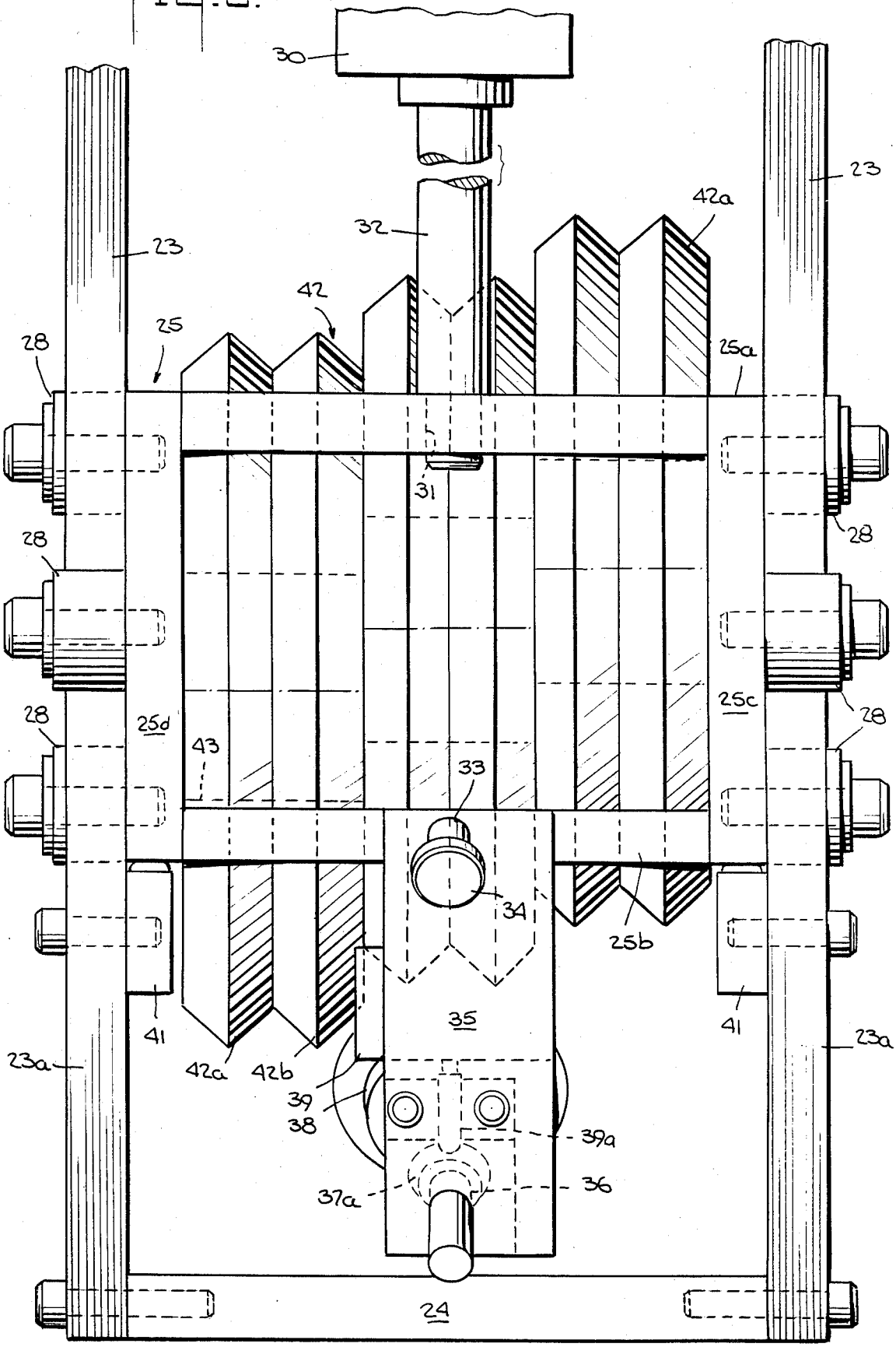
FIG. 5 is a fragmentary elevation view of a pressing roll assembly in its carriage.

Mounted between the side rails 23*a* of the support frame 23 is a carriage housing 25 (FIGS. 4 and 5). The carriage is formed by an upper support 25*a*, a lower support 25*b* and two side supports 25*c* and 25*d*. The four supports 25*d* are bolted together to form the carriage housing 25. Each side support 25*c* and 25*d* has three rollers 28 pivotally mounted thereon. Three rollers 28 are positioned in a staggered manner on the opposite sides of each side rail 23*a* so that when the carriage housing 25 is positioned between the side rails 23*a*, the carriage housing is guided by the rollers when the housing is moved up and down between the side rails and two rollers 28 in contact with the edges of the side rails.

Near the upper end of each of the side rails 23*a*, a support 29 is mounted between side rails 23*a* (FIG. 4). A pneumatic actuator 30 is mounted between the support 29 and the carriage housing 25. The lower end of the actuator 30 is bolted to the support 29. The upper support 25*a* of the carriage 25 is provided with a tapped hole 31 therein. The lower end of the piston 32 of the actuator is threadedly engaged with the tapped hole 31.

Figure 12:
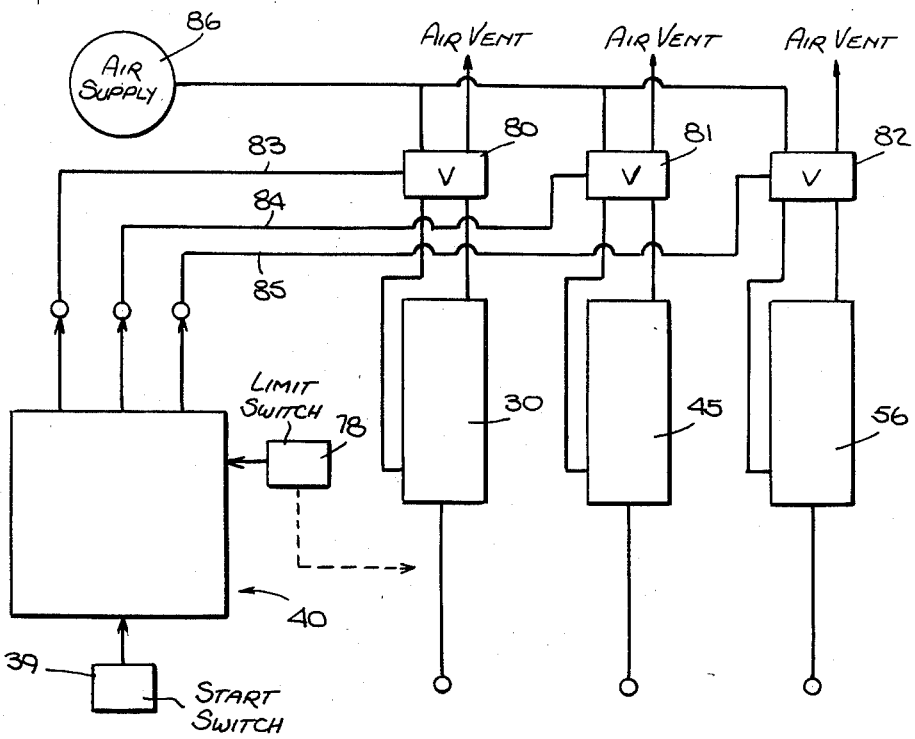
FIG. 12 is a schematic diagram showing the pneumatic circuit for the actuators of the apparatus, a control center for the apparatus, and a system of valves for supplying pneumatic pressure to the actuators.

The lower support 25*b* of the carriage 25 has a tapped hole 33 in its right side as viewed in FIG. 4 and adjacent its midpoint (FIG. 5). A support rod 34 is threadedly engaged with this tapped hole. A bracket 35 is fixed to and extends downwardly from the rod 34. A circular passage 36 extends through the lower end of the bracket 35, so that the axis of the passage is horizontal when the carriage housing 25 and the carriage support frame 23 are in their starting position (FIG. 6). A cylindrical rod 37 is fitted into the passage 36, so that it has limited freedom of movement in the direction of its longitudinal axis. To the end of the rod 37 nearest to the table 21 is affixed a flat circular disc 38. A switch 39 having plunger 39*a* is mounted on the bracket 35 so that when the rod 37 is moved in a direction away from the table 21, the switch 39 is operated by cam 37*a* mounted on rod 37. The switch 39 is connected to a control mechanism 40 (FIG. 12) which controls the timing and sequence of the operation of the apparatus. Actuation of the switch 39 initiates the automatic cycle of operation of the machine of the invention.

Mounted on the inside of each side rail 23*a* of the support frame is a stop block 41 which serves to limit the downward movement of the carriage housing 25 by the engagement of lower support 25 therewith (FIG. 5).

As shown in FIG. 5, mounted between the side supports 25*c* and 25*a* of the carriage housing 25 are a set of pressing rolls 42 comprising six rolls 42*a*. The rolls 42*a* are mounted on stepped axles 43 and the rims 42*b* of the rolls are designed to mate with the ridges on the vertical side of the table 21 and the iron 65 (FIG. 6).

Referring again to FIG. 4 and FIG. 6, a second pneumatic cylinder 45 or actuator is mounted between the support frame 23 and the main frame 11 of the machine. Two brackets 46 are attached to the carriage support frame 23, one being bolted to the inside of each side rail 23*a* at a point above the rest position of the carriage housing 25. Each bracket 46 which extends beyond the side of the rail in a direction extending away from the table 21 has an opening extending therethrough. A shaft 47 is mounted in the openings in the brackets 46. A cross-piece 48 is mounted between the uprights 14

Figure 7:
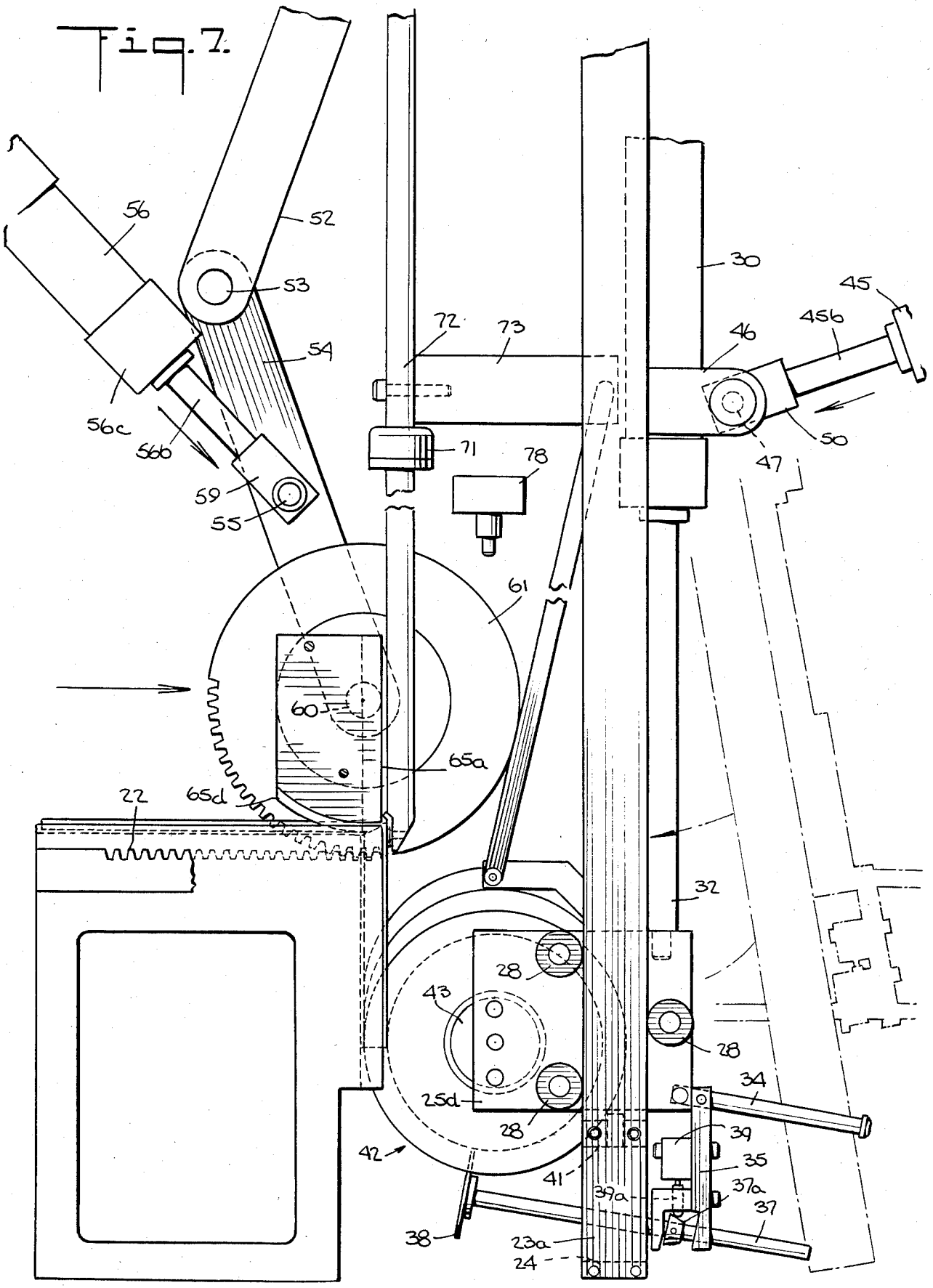
FIG. 7 is a fragmentary elevation view of the apparatus showing the pressing roll in its lowest position, pressed against the vertical side of the table, and the iron disposed adjacent the top of the table.
Figure 8:
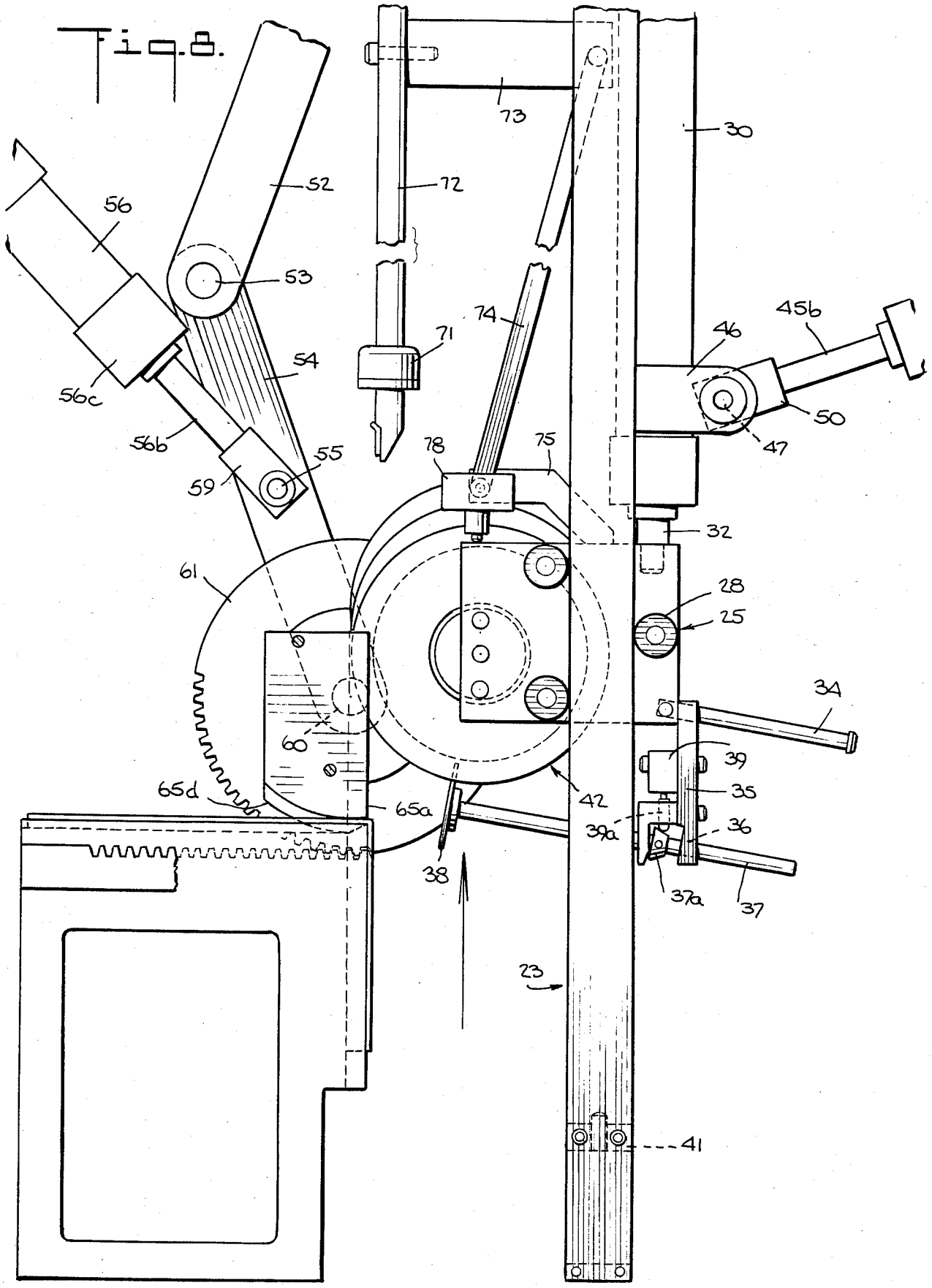
FIG. 8 is a fragmentary elevation view of the apparatus showing the pressing roll after the completion of its upward movement.

(FIG. 4). A pivotal joint 49 is attached to the cross-piece 48. The base end 45*a* of the second actuator 45 is attached to the pivotal joint 49. The head end 45*b* of the piston rod of actuator 45 is attached to a yoke 50 which is rotatably mounted on the axle 47 (FIGS. 6, 7 and 8). This actuator moves the carriage support frame 23 from right to left as seen in FIGS. 4, 6, 7 or 8 such that at full extension of the actuator 45, the pressing rolls 42 mounted on the carriage housing 25 are held against the side of the table 21 or iron 65 as shown in FIG. 7.

Pivotally suspended from the second cross-shaft 20 mounted in the top portion of frame 11 are two support arms 52 (FIG. 4). The arms 52 have circular openings at their lower ends in which a fourth shaft 53 is mounted. Pivotally supported by the fourth shaft 53 are two links 54. A fifth shaft 55 is mounted between the links 54 at about their midpoint. Connected to this shaft 55 is a third pneumatic cylinder or actuator 56. The base end 56*a* of the actuator 56 is connected to a hinged joint 57 which is in turn bolted to a second cross-piece 58 mounted between two end uprights 14 of the main frame 11. The head 56*c* end of the piston rod 56*b* of the cylinder is connected to a yoke 59 mounted and positioned on the fifth shaft 55.

An opening 54*a* is provided in the lower end of each link 54. A stub shaft 60 is pivotally mounted in each opening 54*a* of link 54. Attached to each stub shaft 60 is a cog-wheel 61 which is designed to cooperate with the rack 22 attached to the sides of the table 21. Mounted inside of each cog-wheel is a plate 63 of smaller diameter than the cog-wheel (FIG. 9). Openings 63*a* are provided in the two plates. Corresponding openings 65*a* extend through the iron 65. Cap screws 64 extend through the openings in the plates and the iron and clamp them together. The plates 63 are affixed to the cog-wheels by plates 64 and cap screws 64*a* so that when the cog-wheels turn, the iron 65 rotates with them. Stub shafts 60 secured to plates 63 pivotally engage links 54 adjacent the free end of each stub shaft. A cap screw 66 is mounted in the free end of each stub shaft (FIG. 4). One end of a coil spring 67 is hooked over the head of the cap screw. The opposite or lower end of the spring 67 is attached to the base 12 of the main frame 11 of the apparatus. The spring applies a downwardly directed bias force to the stub shafts 60 which maintain the cog-wheels in mesh with the racks.

The iron 65 can be a solid block. When the iron 65 is rotated down so as to clamp a gusset member between it and the table top, as shown in FIGS. 7 and 8, the vertical side wall or face 65*a* of the iron is chamfered adjacent the intersection with the ridged lower surface or face 65*d* of the iron to accommodate the entry of notches during the formation thereof. In addition its vertical face 65*a* disposed above the ridged side of the table is comprised of alternating crests 65*b* and troughs 65*c* (FIG. 9) which are in alignment with those on the vertical side of the table 21, i.e., a crest aligns with a crest and a trough with a trough. The base 65*d* of the iron 65 is also formed into alternating crests and troughs (FIGS. 6, 7 and 8); however, the ridges on the base of the iron are shifted with respect to crests 65*b* on the face of the iron so that a crest on the iron base of the iron corresponds to a trough 21*d* on the table top. This permits the ridges on the iron to drop down into the troughs on the table top so that the iron 65 can clamp the gusset member firmly against the table top. In addition, the base 65*d* of the iron is arcuate in form to enable the base to clear the top of the table as the iron is rotated (FIGS. 6 and 7).

Attached to the fifth upright 70 (FIG. 4) of the main frame 11 are two guides 71 which extend inwardly from the upright and which have vertical openings through each of them. Passing through these guides 71 is a pressure rod 72 (FIGS. 6, 7 and 8). Attached to the pressure rod 72 is a horizontal bracket 73 which is mounted to extend in a direction away from the table. A linkage arm 74 is pivotally attached to the end of the bracket 73 opposite the pressure rod. A second linkage arm 75 is pivotally attached to the lower end of the first linkage arm 74. The opposite end of the second linkage arm is attached to the carriage housing 25. Attached to the U-shaped member 79 (FIG. 4) hanging from the top frame is a limit valve 78 which resets the machine to its start position upon completion of a cycle of operation.

The control device 40 (FIG. 12) mentioned above in connection with the activation switch can be a logic system which, upon activation, controls the timing and sequence of operation of the three actuators 30, 45 and 56 of the machine. In a preferred embodiment, each of the pneumatic cylinders or actuators 30, 45 and 56 is connected to valves 80, 81 and 82, respectively, which are adapted to either supply air from an exterior air supply or reservoir 86 to the actuator or vent air from the actuator. Each of valves 80, 81 and 82 is connected to the control device 40 by lines 83, 84 and 85, respectively. The operation of the valves is dictated by the control logic embodied in the control device 40. In a preferred embodiment, according to the invention, the control device is an air logic system.

OPERATION

The cycle of operation is shown by the timing diagram of FIG. 11. Operation of the machine is started by insertion of gusset members A into the machine. Before inserting three to six gusset members into the machine, the gusset members are provided with a number of lengthwise pleats of sufficient number for the type of folder desired. Each gusset member has previously been scored at two places located across its width at right angles and at any desired location with respect to the pleats. See FIG. 3. The gusset members A are then inserted into the machine between the guards 18 mounted on the uprights 14 so that the gusset members are stacked with their pleats nested on top of the table 21. The gusset members are advanced into the machine until the end portion of them contacts the flat circular disc 38. Pressure against this disc forces the rod 37 to the right as viewed in FIGS. 4 and 6. Movement of the rod 37 causes cam 37*a* to operate the switch 39 which starts the automatic operation of the apparatus as determined by the control logic 40.

Upon activation of the cycle of operation, the first actuator 30 moves the carriage housing 25 downwardly along its support frame 23. The control 40 activates actuator 45 to move the support frame 23 toward the table 21. These two motions combine in moving the pressing rolls 42 downwardly and toward the table 21 as shown in FIGS. 6 and 7 so that upon completion of the strokes of the actuators 30 and 45, the pressing rolls 42 are brought against the vertical ridged side of the table 21. During this process, the pressing rolls contact the stacked gusset members A and fold them downwardly against the vertical side of the table.

Also upon activation, the control 40 causes the third actuator 56 to commence to move the shaft 55 to the right as seen in FIG. 4 and thereby rotating links 54 in a clockwise direction. The movement of links 54 causes the cog-wheels 61 to roll in a clockwise direction along the racks 22. During this movement, the springs 67 hold the cog-wheels firmly against the racks 22. This movement of the cog-wheels rotates the iron 65 in a clockwise direction down onto the upper surface of the stacked gusset members A, thereby clamping them between the iron 65 and the top of the table 21 (FIGS. 7, 8 and 9).

The descent of the carriage housing 25 causes, by means of the two linkage arms 74 and 75 and the horizontal bracket 73, the descent of the pressure rod 72 (FIGS. 6 and 7). When the pressure rod 72 reaches its lowest position, its bottom end is slightly below the level of the top of the table (FIG. 7). The pressure rod 72 serves to hold the folded gusset members A firmly against the vertical side of table 21 in order to prevent movement of the gusset members as the pressing rolls move upwardly in contact therewith.

At this point, the first actuator 30 commences to retract in response to control 40, moving the carriage housing 25 upwardly. This movement causes the wheels 42 to roll upward along the table pressing the gusset members A between themselves and the side of the table 21. As the pressing rolls pass the top of the table, the rolls together with the ridges on the iron 65 and on the side of the table 21, coact to form notches 3 extending along the bottom portion of the gusset member at the corner or folded portion thereof. Of course, at the same time the upward motion of the carriage housing 25 forces the pressure rod 72 to rise. As the carriage housing reaches its maximum ascent and the first actuator has completed its cycle, one of the pressing rolls of the carriage housing 25 contacts the reset switch 78. After this the control logic orders the second actuator 45 and the third actuator 56 to retract, thus returning the support frame 3 and the iron 65 to their original positions.

The gusset members can now be removed from the apparatus. The gusset members are then reversed and inserted for a second time into the machine to be given a second accordion fold and the formation of notches 3. After this, each gusset member is ready to be used, together with a pair of side-walls, to form an expendable envelope. By way of example, as many as three to six gussets can be notched at once with each gusset having three to seven hills or crests with the scores for the corner portions (FIG. 3) spaced three to twelve inches from one another.

The above described method and apparatus can be easily adapted and used to form a folded corner portion in other fluted or pleated materials which are to be used to make curtains, lampshades or other similar items. The method would be essentially unchanged and the apparatus would be adapted only so far as necessary to allow insertion of pleated members made from the particular material being worked upon and in light of the particular fold that is desired in the material. As in the method used to form gusset members for use in expandable envelopes, the pleated member can be inserted into the apparatus several times in order to achieve the required number of folds.

What is claimed is:

1. Apparatus for folding and notching a pleated gusset member to form the end walls and the bottom wall of an expandable envelope comprising:

a frame, a table mounted to said frame having a ridged upper surface of crests and grooves adapted to receive the pleats of the bottom wall portion of a gusset member when the gusset member is disposed thereon with an end wall portion projecting beyond an end portion of the table extending transversely to the crests and grooves of the ridged surface, the table having a ridged side surface of crests and grooves intersecting the ridged upper surface with the respective crests and grooves in alignment with one another, means mounted to said frame for pressing the pleats of the bottom wall portion of the gusset member into the grooves of the ridged upper surface of the table, the pressing means including an iron having a ridged lower surface of crests and grooves adapted to nest with respect to the ridged upper surface of the table to press the pleats of the bottom wall portion of the gusset member into the ridged upper surface of the table, the iron further having a vertical side wall intersecting the ridged lower surface, the vertical side wall being chamfered adjacent the intersection with the ridged lower surface to accommodate the entry of the notches during the formation thereof, means mounted to said frame for urging the pleats of the end wall portion of the gusset member against the ridged side surface of the table adjacent the intersection of the ridged side surface and the ridged upper surface of the table to fold the gusset member at the intersection of an end wall portion and a bottom wall portion of a gusset member and to form a notch extending from adjacent each groove of the end wall portion into the corresponding groove of the bottom portion adjacent the fold in the gusset member, the urging means including a support member mounted to said frame and at least one pressing roll pivotally mounted to said support member for rolling with respect to the grooves of the vertical side of the table to urge the pleats of the end wall portion into the ridged side surface of the table, the urging means further including means for moving the pressing roll upwardly in a rolling engagement with the end wall portion of the gusset member to adjacent the intersection of the upper ridged surface and the ridged side surface of the table to fold the end wall portion of the gusset member and to form the notches adjacent to the fold.

2. Apparatus in accordance with claim 1 in which the urging means comprises an array of pressing rolls, each of the rolls being pivotally mounted to said support member to roll with respect to a different one of the grooves of the vertical side of the table to urge the pleats of the end wall portion into the ridged surface of the ridged side surface of the table, said means for moving being operatively coupled to the array of pressing rolls for shifting same in an upwardly extending direction while the pressing rolls are in rolling engagement with the end wall portion of the gusset member to adjacent the intersection of the upper ridged surface and the ridged side surface of the table to fold the end wall portion of the gusset member and to form the notches adjacent to the fold.

3. Apparatus in accordance with claim 2 in which each of the array of pressing rolls comprises a roll having a beveled rim adapted to mate with a groove of the ridged side surface of the table.

4. Apparatus in accordance with claim 2 in which the pressing rolls are pivotally mounted to said support member at a plurality of different centers of rotation, the different centers of rotation placing the rolls at different levels when the rolls are in engagement with the end wall portion of the gusset member in order to stagger the formation of the notches by the pressing rolls.

5. Apparatus in accordance with claim 1 and further comprising means for cyclically moving the urging means downwardly into engagement with the end wall portion of the gusset member, laterally to press the pleats of the end wall portion into the ridged side surface of the table, and upwardly while the urging means is in contact with the end wall portion of the gusset member to form the notches therein.

6. Apparatus in accordance with claim 5 and further comprising means for holding the gusset member with respect to the intersection of the ridged top surface and the ridged side surface of the table prior to the forming of the notches and means coupled to the moving means for placing the holding means into engagement with the gusset member in response to the movement of the means for moving the urging means.

7. Apparatus in accordance with claim: 1 and in which the vertical side wall of the iron comprises a ridged side surface intersecting the ridged lower surface thereof, the crests and grooves of the ridged side surface of the iron being in alignment with those of the ridged side surface of the table when the iron is pressing the pleats of the bottom wall portion of the gusset member into grooves of the ridged upper surface of the table.

8. Apparatus in accordance with claim 7 and further comprising means for cyclically moving the iron to place the ridged lower surface thereof adjacent the ridged upper surface of the table with the ridged side surface of the iron substantially in alignment with the ridged side surface of the table.

9. Apparatus in accordance with claim 1 and further comprising means for activating the operation of the apparatus in response to engagement thereof with the unfolded end wall portion of a gusset member when the bottom portion of the gusset member is placed on the ridged upper surface of the table.

10. Apparatus in accordance with claim 1 in which the ridged lower surface of the iron is curved to enable the iron to be rolled into a nesting relationship with the ridged upper surface of the table.

11. Method for folding and notching a pleated gusset member to form the end walls and the bottom wall of an expandable envelope comprising the steps of:

placing the bottom wall portion of a gusset member on a first ridged surface of crests and grooves adapted to receive the pleats of the bottom wall portion with an end wall portion of the gusset member projecting beyond an end portion of the ridged surface, pressing the pleats of the bottom wall portion of the gusset member into the grooves of the ridged surface, and urging the pleats of the end wall portion of the gusset member against a second ridged surface of crests and grooves intersecting the first ridged side surface with the crests and grooves being commonly aligned, the urging of the pleats of the end wall against the second ridged surface folding the gusset member at the intersection of an end wall portion and the bottom wall portion of the gusset member and forming a notch extending from adjacent each groove of the end wall portion into the corresponding groove of the bottom portion adjacent the fold in the gusset member, providing a chamfered surface adjacent the intersection of the first ridged surface and the second ridged surface for accommodating the entry of notches upon the formation thereof during the step of urging, the step of urging the pleats of the end wall of the gusset member against the second ridged surface comprising the step of rolling a rotatable element against the end wall portion with respect to the grooves of the second ridged surface to force the pleats of the end wall portion into the second ridged surface, the rolling proceeding in an upward direction, while the rotatable element is in rolling engagement with the end wall portion of the gusset member, to adjacent the intersection of the first ridged surface and the second ridged surface to fold the end wall portion of the gusset member and to form the notches adjacent to the fold.

12. Method in accordance with claim 11 in which the step of urging the pleats of the end wall portion of the gusset member against the second ridged surface comprises providing a rolling engagement of an array of rotatable elements with the end wall portion, the rotatable elements having a plurality of different centers of rotation, the different centers of rotation being at different levels when the rotatable elements are in engagement with the end wall portion of the gusset member in order to stagger the formation of notches by the rolling engagement.

13. Method in accordance with claim 11 and further comprising the step of commencing the folding and notching of the pleated gusset member in response to the placing of the unfolded end wall portion of the gusset member at a predetermined position as the bottom portion of the gusset member is placed on the first ridged surface.

14. Apparatus for folding and notching a pleated member to form a folded corner in the pleated member comprising:

a frame, a table mounted to said frame having a ridged upper surface of crests and grooves adapted to receive the pleats of the main portion of a pleated member when disposed thereon with an end portion of the pleated member projecting beyond an end portion of the table extending transversely to the crests and grooves of the ridge surface, the table having a ridged side surface of crests and grooves intersecting the ridged upper surface with the respective crests and grooves in alignment with one another, means mounted to said frame for pressing the pleats of the main portion of the pleated member into the grooves of the ridged upper surface of the table, the pressing means including an iron having a ridged lower surface of crests and grooves adapted to nest with respect to the ridged upper surface of the table to press the pleats of the main portion of the pleated member into the ridged upper surface of the table, the iron further having a vertical side wall intersecting the ridged lower surface, the vertical side wall being chamfered adjacent the intersection with the ridged lower surface to accommodate the entry of notches during the formation thereof, means mounted to said frame for urging the pleats of the end portion of the pleated member against the ridged side surface of the table adjacent the intersection of the ridged side surface and the ridged upper surface of the table to fold the pleated member at the intersection of an end portion and a main portion of a pleated member and to form a notch extending from adjacent each groove of the end portion into the corresponding groove of the main portion adjacent the fold in the pleated member, and means mounted to said frame for cyclically moving the urging means downwardly into engagement with the end portion of the pleated member, laterally to press the pleats of the end portion into the ridged side surface of the table, and upwardly while the urging means is in contact with the end portion of the pleated member to form the notches therein.

15. Method for folding and notching a pleated member to form a folded corner in the pleated member, comprising the steps of:

placing the main portion of a pleated member on a first ridged surface of crests and grooves adapted to receive the pleats of the main portion with an end portion of the pleated member projecting beyond an end portion of the ridged surface, pressing the pleats of the main portion of the pleated member into the grooves of the ridged surface, and urging the pleats of the end portion of the pleated member against a second ridged surface of crests and grooves intersecting the first ridged side surface with the crests and grooves being commonly aligned, the urging of the pleats of the end portion against the second ridged surface folding the pleated member at the intersection of an end portion and the main portion of the pleated member and forming a notch extending from adjacent each groove of the end portion into the corresponding groove of the main portion adjacent the fold in the pleated member, providing a chamfered surface adjacent the intersection of the first ridged surface and the second ridged surface for accommodating the entry of notches upon the formation thereof during the step of urging, the step of urging the pleats of the end portion of the pleated member against the second ridged surface comprising the steps of moving a rotatable element downwardly into engagement with the end portion of the pleated member, laterally to press the pleats of the end portion into the ridged side surface of the table, and upwardly while the rotatable element is in contact with the end portion of the pleated member to form the notches therein.

16. Apparatus for folding and notching a pleated gusset member to form the end walls and the bottom wall of an expandable envelope, comprising:

a frame, a table mounted to said frame having a ridged upper surface of crests and grooves adapted to receive the pleats of the bottom wall portion of a gusset member when disposed thereon with an end wall portion projecting beyond an end portion of the table extending transversely to the crests and grooves of the ridged surface, the table having a ridged side surface of crests and grooves intersecting the ridged upper surface with the respective crests and grooves in alignment with one another, means mounted to said frame for pressing the pleats of the bottom wall portion of the gusset member into the grooves of the ridged upper surface of the table, the pressing means comprising an iron having a ridged lower surface of crests and grooves adapted to nest with respect to the ridged upper surface of the table to press the pleats of the bottom wall portion of the gusset member into the ridged upper surface of the table, the iron further comprising a ridged side surface intersecting the ridged lower surface thereof, the crests and grooves of the ridged side surface of the iron being in alignment with those of the ridged side surface of the table when the iron is pressing the pleats of the bottom wall portion of the gusset member into the grooves of the ridged upper surface of the table, and means mounted to said frame for urging the pleats of the end wall portion of the gusset member against the ridged side surface of the table adjacent the intersection of the ridged side surface and the ridged upper surface of the table to fold the gusset member at the intersection of an end wall portion and a bottom wall portion of a gusset member and to form a notch extending from adjacent each groove of the end wall portion into the corresponding groove of the bottom portion adjacent the fold in the gusset member.

17. Apparatus in accordance with claim 16 in which the ridged side surface of the iron is chamfered with respect to its intersection with the ridged lower surface of the iron to facilitate the forming of the notches.

18. Apparatus in accordance with claim 16, further comprising means for cyclically moving the iron to place the ridged lower surface thereof adjacent the ridged upper surface of the table with the ridged side surface of the iron substantially in alignment with the ridged side surface of the table.

19. Apparatus for folding and notching a pleated gusset member to form the end walls and the bottom wall of an expandable envelope comprising:

a frame, a table mounted to said frame having a ridged upper surface of crests and grooves adapted to receive the pleats of the bottom wall portion of a gusset member when disposed thereon with an end wall portion projecting beyond an end portion of the table extending transversely to the crests and grooves of the ridged surface, the table having a ridged side surface of crests and grooves intersecting the ridged upper surface with the respective crests and grooves in alignment with one another, means mounted to said frame for pressing the pleats of the bottom wall portion of the gusset member into the grooves of the ridged upper surface of the table, the pressing means comprising an iron having a ridged lower surface of crests and grooves adapted to nest with respect to the ridged upper surface of the table to press the pleats of the bottom wall portion of the gusset member into the ridged upper surface of the table, the ridged lower surface of the iron being curved to enable the iron to be rolled into a nesting relationship with the ridged upper surface of the table, and means mounted to said frame for urging the pleats of the end wall portion of the gusset member against the ridged side surface of the table adjacent the intersection of the ridged side surface and the ridged upper surface of the table to fold the gusset member at the intersection of an end wall portion and a bottom wall portion of a gusset member and to form a notch extending from adjacent each groove of the end wall portion into the corresponding groove of the bottom portion adjacent the fold in the gusset member.

* * * * *

UNITED STATES PATENT AND TRADEMARK OFFICE

CERTIFICATE OF CORRECTION

PATENT NO. : 4,540,390

DATED : September 10, 1985

INVENTOR(S) : Donald Thorschmidt

It is certified that error appears in the above-identified patent and that said Letters Patent is hereby corrected as shown below:

Column 1, line 37, delete "tedious and" and insert --tedious, but also--

Column 1, line 47, delete "alignment with" and insert --alignment, with--

Column 1, line 64, delete "is" and insert --are--

Column 2, line 17, delete "forming" and insert --form--

Column 3, line 10, delete "FIG. 13 and 14" and insert --FIGS. 13 and 14--

Column 3, line 32, delete "apeces" and insert --apexes--

Column 4, line 10, delete "25d" and insert --25a-d--

Column 7, line 36, delete "this the" and insert --this, the--

Column 7, line 44, delete "an expendable" and insert --an expandable--

UNITED STATES PATENT AND TRADEMARK OFFICE

CERTIFICATE OF CORRECTION

PATENT NO. : 4,540,390

DATED : September 10, 1985

INVENTOR(S) : Donald Thorschmidt

It is certified that error appears in the above-identified patent and that said Letters Patent is hereby corrected as shown below:

Column 9, line 25, delete "claim: 1" and insert --claim 1--

Column 10, line 50, delete "ridge surface" and insert --ridged surface--

Signed and Sealed this

*Eighteenth* Day of *March 1986*

[SEAL]

*Attest:*

DONALD J. QUIGG

*Attesting Officer* *Commissioner of Patents and Trademarks*